US005166483A

United States Patent [19]

Kersusan et al.

[11] Patent Number: 5,166,483

[45] Date of Patent: Nov. 24, 1992

[54] ELECTRICAL CIRCUIT BREAKER WITH ROTATING ARC AND SELF-EXTINGUISHING EXPANSION

[75] Inventors: Jean-Pierre Kersusan, Vif; Hugues Filiputti, Monestier de Clermont; Victor Pennucci, Seyssinet-Pariset, all of France

[73] Assignee: Merlin Gerin, France

[21] Appl. No.: 707,897

[22] Filed: May 30, 1991

[30] Foreign Application Priority Data

Jun. 14, 1990 [FR] France ..... 90 07558

[51] Int. Cl.[5] ..... H01H 9/30; H01H 33/82

[52] U.S. Cl. ..... 200/144 A; 200/148 B

[58] Field of Search ..... 200/144 A, 145, 146, 200/147, 148, 149, 150

[56] References Cited

FOREIGN PATENT DOCUMENTS 0277848 8/1988 European Pat. Off. .
2546490 7/1978 Fed. Rep. of Germany .
2105575 4/1972 France .
8600169 1/1986 World Int. Prop. O. .

*Primary Examiner*—Harold Broome
*Attorney, Agent, or Firm*—Parkhurst, Wendel & Rossi

[57] ABSTRACT

A three-phase circuit breaker with self-extinguishing expansion and rotating arc structures comprises an arc extinguishing chamber per pole and housing a pair of contacts, one stationary and one moveable, a coil to rotate the arc, and an exhaust channel in at least one contact to provide an opening a communication and gas outflow between the extinguishing chamber and the expansion volume of an enclosure filled with SF6. The extinguishing chamber has a square or rectangular cross-section to resorb the gas plug after braking of the gas rotation movement, and improve stirring of the gas in the extinguishing chamber.

9 Claims, 4 Drawing Sheets

ELECTRICAL CIRCUIT BREAKER WITH ROTATING ARC AND SELF-EXTINGUISHING EXPANSION

BACKGROUND OF THE INVENTION

The invention relates to an electrical circuit breaker with self-extinguishing expansion comprising one or more poles housed in a sealed enclosure filled with an insulating gas with a high dielectric strength, notably sulphur hexafluoride, each pole having an arc extinguishing chamber housing :

a stationary contact, a movable contact securedly united to a sliding pin passing tightly through a wall of the extinguishing chamber, means for rotating an arc which is formed when the contacts separate, and a gas exhaust channel arranged in at least one of the contacts to provide communication and gas outflow between the extinguishing chamber and the expansion volume of the enclosure when the contacts separate.

The presence of a rotating arc in a self-extinguishing expansion circuit breaker having an extinguishing chamber with a cylindrical revolution surface causes a uniform rotation movement of hot gas around the arcing area between the separated contacts. Depending on the intensity of the current to be broken, this gas movement limits the gas exchanges between the other volumes of the extinguishing chamber, and is liable to decrease the quality of the gas outflow during the extinguishing period.

A rotating gas plug may even partially obstruct the exhaust channel inlet, limiting the gas outflow, which compromises extinguishing of the arc.

The object of the invention consists in improving the breaking performances of a circuit breaker with self-extinguishing expansion and arc rotation.

SUMMARY OF THE INVENTION

The circuit breaker according to the invention is characterized in that the extinguishing chamber of each pole presents a square or rectangular cross-section, designed to disturb the rotation movement of the gas to improve stirring in the extinguishing chamber and obtain an optimum gas outflow in the exhaust channel.

For predetermined circuit breaker dimensions, adopting an extinguishing chamber of square or rectangular cross-section provides the following advantages :

establishment of a maximum volume for the gas pressure increase in the extinguishing chamber, resorption of the gas plug after braking of the gas rotation movement to facilitate the gas outflow in the exhaust channel, improvement of the quality of the gas present in the gas outflow.

This results in an improvement of the self-extinguishing expansion effect of the gas, favoring high-speed extinguishing of the arc.

According to an embodiment of the invention, confinement of the extinguishing chambers of the different poles is achieved by assembly of two conjugate half-shells, fixed together by means of fixing screws to form a single-piece insulating enclosure.

In each pole there is a seal having a shape conjugate with the extinguishing chamber, and located in the assembly plane of the two half-shells.

A shielding wall is arranged inside each extinguishing chamber, by applying the seal against two internal bevels of the abutted half-shells.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

In the figures, a three-phase circuit breaker 10 with rotating arc means and self-extinguishing expansion is used in a cubicle of a high-voltage electrical substation with full gas insulation, whose structure is described as an example in French Patent 2,507,835. The circuit breaker 10 is housed in a sealed enclosure (not represented) forming the downstream expansion volume filled with electronegative insulating gas with a high dielectric strength, notably sulphur hexafluoride SF6.

Figure 4:
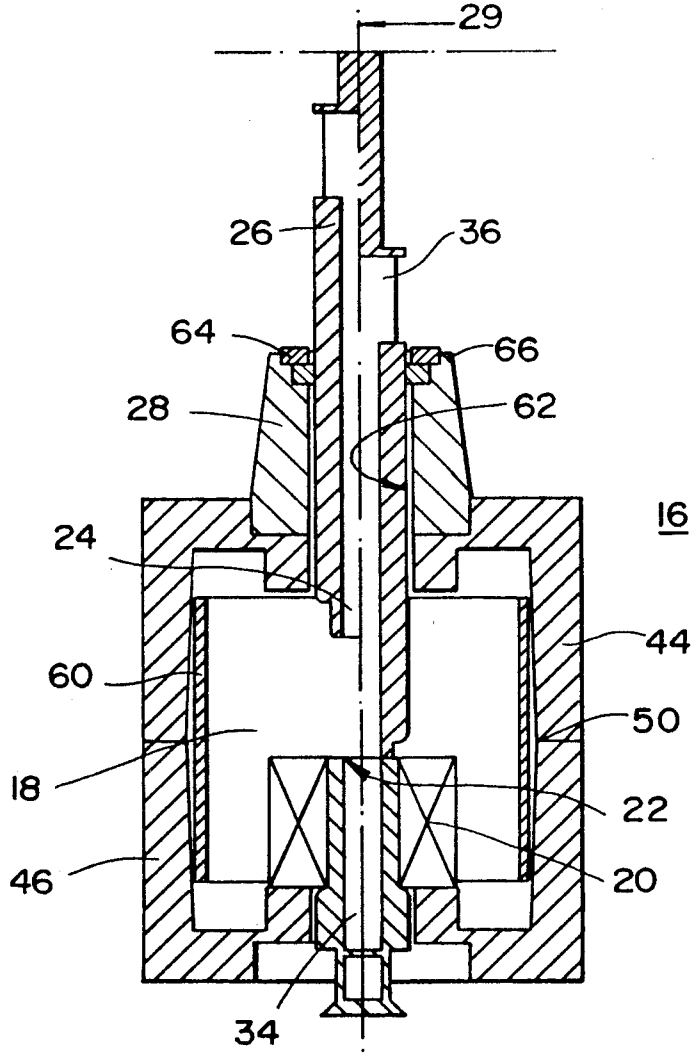
FIG. 4 represents a cross-sectional view along the line 4—4 of FIG. 2.

The three poles 12, 14, 16 of the circuit breaker 10 are identical, and only the pole 16 (FIG. 4) will be described in detail hereafter. The pole 16 is equipped with an extinguishing chamber 18 containing an electromagnetic coil 20 for rotation of the arc on an annular track of the stationary contact 22, and a movable contact 24 supported by a conducting pin 26 sliding along a fixed guide sleeve 28 in the direction of the longitudinal axis 29 of the pole 16. The pin 26 is mechanically connected to a crankhandle of the operating mechanism (not represented) to enable the movable contact 24 to be actuated in translation from the closed position (right-hand half-view, FIG. 4) to the open position (left-hand half-view, FIG. 4) when the circuit breaker 10 opens, and conversely from the open position to the closed position when the circuit breaker 10 closes.

The coil 20 is of the type described in the document FR-A-2,464,550. The assembly formed by the stationary contact 22 and coil 20 of each pole 12, 14, 16 is connected by means of a connecting terminal pad 30 to the corresponding bar of a three-phase busbar 32, located outside the extinguishing chamber 18 in the bottom of the substation enclosure. Exhaust channels 34, 36 are arranged axially through the contacts 22, 24, the magnetic core 38 of the coil 20, and the pin 26 to provide a double communication upstream and downstream between the extinguishing chamber 18 of each pole 12, 14, 16, and the expansion volume 40 of the enclosure. This communication enables a gas outflow to the expansion volume 40, when an electrical arc is interrupted in the corresponding extinguishing chamber 18.

The circuit breaker 10 presents a one-piece casing 42 made of molded insulating material, formed by assembly of two symmetrical half-shells 44, 46 enabling internal confinement of the extinguishing chambers 18 of the three poles 12, 14, 16. The two half-shells 44, 46 are fixed together by a plurality of fixing screws 48 with three seals 50 arranged in the assembly plane at the level of the mid-zone of the the extinguishing chambers 18. Each half-shell 44, 46 comprises three compartments in line, separated from one another by two intermediate partitions 52, 54; 56, 58, each compartment having a square cross-section. The assembly plane of the half-shells 44, 46 extends in a horizontal plane perpendicular to the longitudinal axis 29 of each pole 12, 14, 16.

Figure 1:
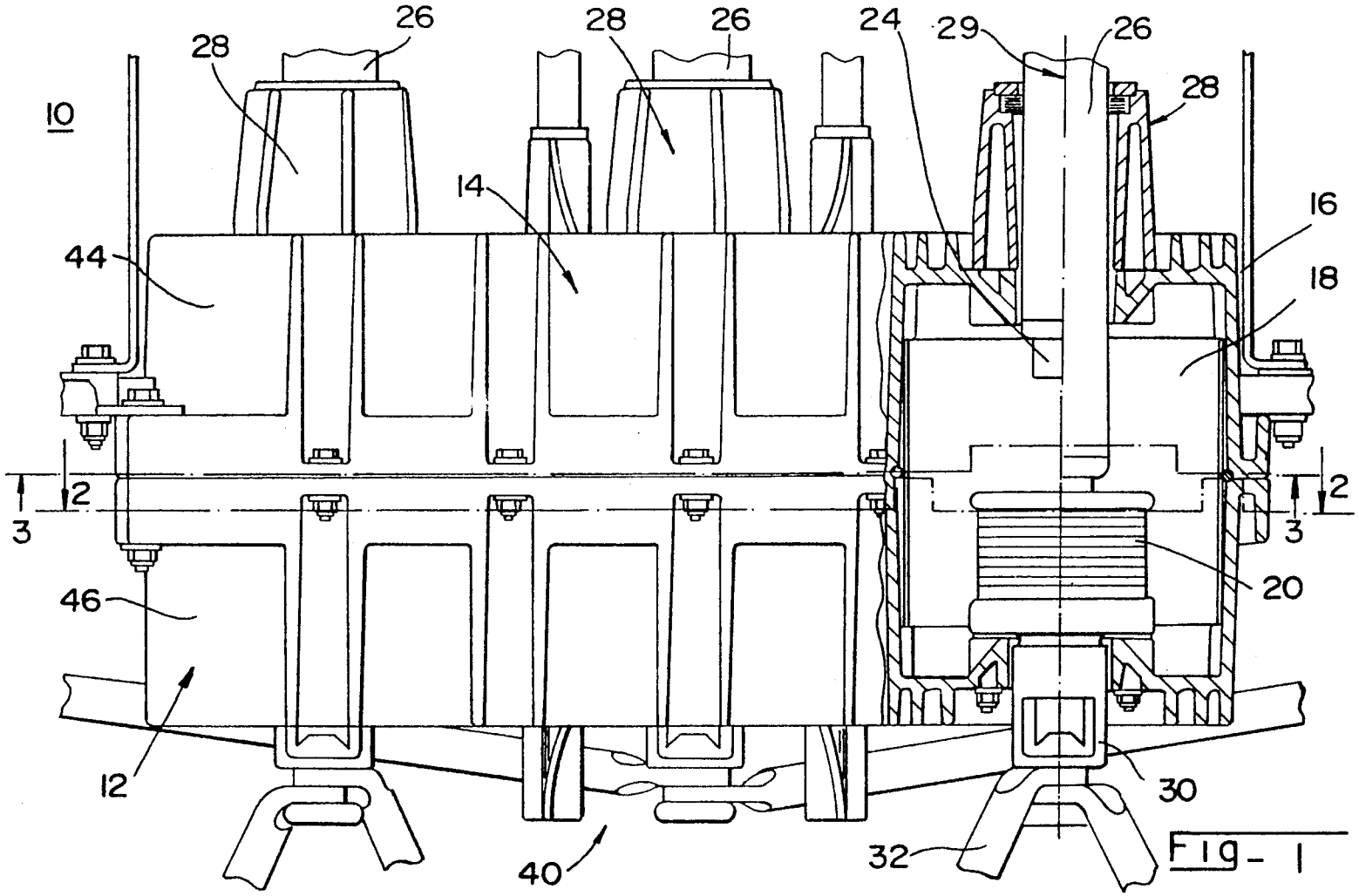
FIG. 1 is a schematic view of the three-phase circuit breaker connected to a busbar of a cubicle, the right-hand pole being represented partially in cross-section.
Figure 2:
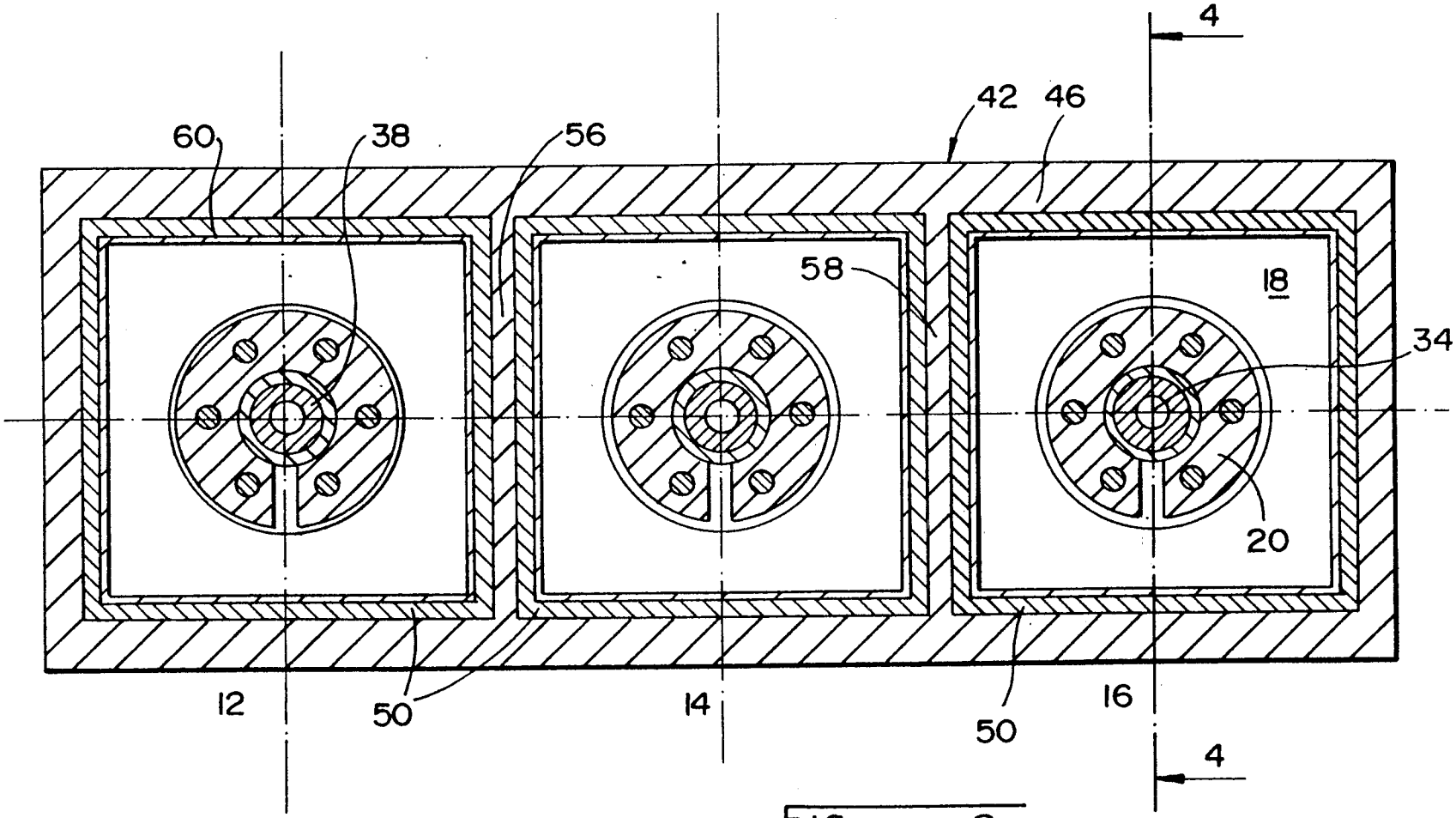
FIG. 2 is a cross-sectional view along the line 2—2 of FIG. 1.
Figure 3:
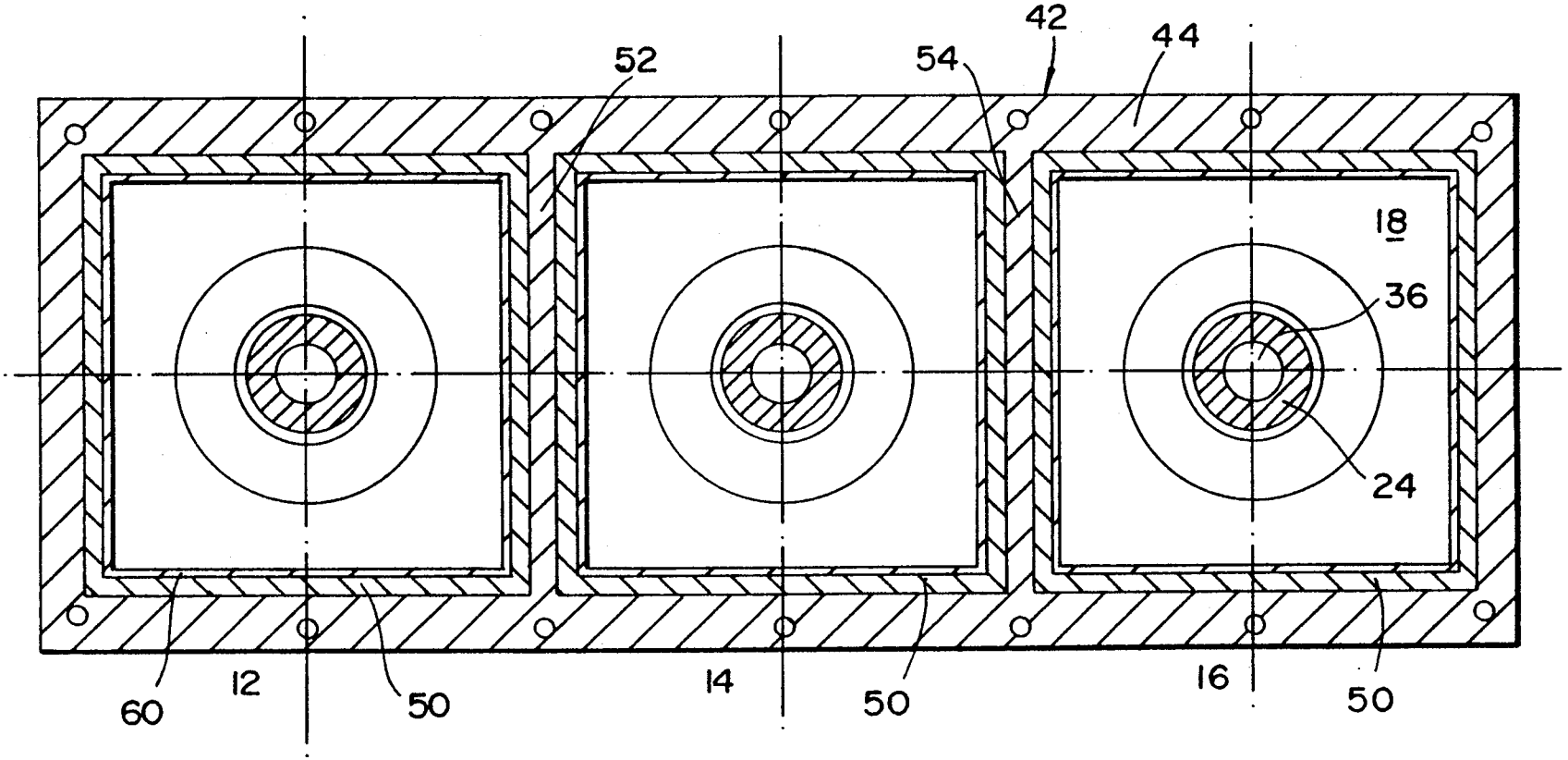
FIG. 3 shows a cross-sectional view along the line 3—3 of FIG. 1.

Formation of each extinguishing chamber 18 results from joining of two conjugate compartments of the half-shells 44, 46. Each chamber 18 has a square cross-section (see FIGS. 2 and 3), inside which the cylindrical coil 20 is housed. The seal 50 of each extinguishing chamber 18 bears on two internal bevels (not shown) arranged on the abutting edges of the half-shells 42, 44, forming a V. A shielding wall 60, for example made of copper, is arranged inside each extinguishing chamber 18, and applies the seal 50 on the V of the bevels with a predetermined pressure. There is no communication between the chambers 18 when the contacts 22, 24 of the poles 12, 14, 16 are closed.

The molded insulating material of the enclosure 42 is advantageously polycarbonate-based having glass fibers, but any other thermoplastic material can be used.

Each axial guide sleeve 28 comprises an annular orifice 62 for the moving pin 26 to pass through, and a retaining ring 64 of an annular-shaped auxiliary seal 66, fitted tightly around the lateral surface of the pin 26. The ring 64 is ultrasonically welded to the insulating sleeve 28. The internal diameter of the seal 66 is smaller than that of the orifice 62. The segment-type seal 66 is made of thermoplastic material.

The three insulating sleeves 28 are also ultrasonically welded to the upper half-shell 44 of the enclosure 42.

The shielding wall 60 has a square cross-section, but any other shape can be envisaged.

Operation of a pole of the self-extinguishing expansion circuit breaker 10 is as follows :

The arc drawn when the contacts 22, 24 separate following an opening order of the circuit breaker 10, is set in rotation in the extinguishing chamber 18 by the action of the magnetic field of the coil 20. Rotation of the arc then creates a peripheral rotation movement of the SF6 gas to the shielding wall 60. The square cross-section of the extinguishing chamber 18 yields on the one hand a maximum gas pressure increase volume, and on the other hand improved stirring of the gas due to the turbulences created in the dead volumes of the square chamber 18, in which the gas does not rotate. This results in a braking effect of the gas rotation movement and optimum gas outflow via the exhaust channels 34, 36 to the expansion volume 40. This gas outflow enables the arc to be extinguished quickly.

The invention can also be applied to a three-phase circuit breaker with separate poles, wherein each pole is confined in a separate insulating case of square cross-section.

The cross-section of the extinguishing chamber 18 can also be rectangular.

We claim:

1. An electrical circuit breaker having an expansion volume and including at least one pole, each of said at least one pole comprising:

a sealed enclosure defining an extinguishing chamber filled with an insulating gas;

a stationary contact in said enclosure;

a movable contact fixed to a sliding pin which gas-tightly passes through said sealed enclosure, said movable contact cooperable with said stationary contact to define open and closed positions;

means for rotating an arc formed between said contacts as said contacts separate towards said open position;

at least one gas exhaust channel in at least one of said contacts to provide gas communication between said sealed enclosure and said expansion volume upon separation of said contacts, wherein said extinguishing chamber has a substantially rectangular cross-section to disturb rotation movement of said gas.

2. The device of claim 1, wherein said cross-section is square.

3. The device of claim 1, wherein said insulating gas is sulfur-hexafluoride.

4. The device of claim 1, wherein said extinguishing chamber is defined by two half-shells attached together with fixing screws and a seal interposed between said two half-shells.

5. The device of claim 1, wherein said means for rotating an arc comprises a cylindrical electromagnetic coil coaxially disposed around said stationary contact.

6. The device of claim 1, further comprising an internal shielding wall arranged against an internal surface of said extinguishing chamber.

7. The device of claim 1, further comprising a tubular insulating sleeve for guiding said sliding pin, said sleeve having one end fixed to said sealed enclosure and a second end including a retaining ring and an annular auxiliary seal such that said retaining ring and said annular auxiliary seal are coaxially disposed around said sliding pin to gas-tightly seal said sliding pin.

8. The device of claim 7, wherein said one end of said sleeve is fixed to said sealed enclosure by ultra-sonic welding.

9. The device of claim 7, wherein said retaining ring is fixed to said sleeve by ultra-sonic welding.

* * * * *